United States Patent [19]

Kemper

[11] Patent Number: 4,941,226

[45] Date of Patent: Jul. 17, 1990

[54] FOLDABLE LOTION APPLICATOR

[75] Inventor: Alicia W. Kemper, Tallahassee, Fla.

[73] Assignee: Innovec, Inc., Tallahassee, Fla.

[21] Appl. No.: 279,979

[22] Filed: Dec. 5, 1988

[51] Int. Cl.[5] ..... B05C 17/10

[52] U.S. Cl. ..... 15/185; 15/104.94; 206/438; 206/210; 206/15.3; 132/315

[58] Field of Search ..... 15/185, 210 A, 244.2, 15/244.1, 104.94; 401/196; 132/294, 295, 300, 314, 315; 206/361, 210, 438, 570, 15.2, 15.3; 604/290

[56] References Cited

U.S. PATENT DOCUMENTS

| | | | |
|---|---|---|---|
| 791,668 | 6/1905 | Apel | 132/315 |
| 922,496 | 5/1909 | Lyon | 15/185 |
| 1,353,954 | 9/1920 | Henry | 206/438 |
| 1,770,344 | 7/1930 | Schmidt | 15/185 |
| 2,173,504 | 9/1939 | Wagner | 15/185 X |
| 2,523,909 | 9/1950 | Kreidler | 15/104.94 |
| 2,542,397 | 2/1951 | Core | 206/361 |
| 2,763,885 | 9/1956 | Lyons | 15/104.94 |
| 2,880,441 | 4/1959 | Rushing | 15/185 X |
| 2,888,133 | 5/1959 | Betteridge | 15/104.94 |
| 3,129,811 | 4/1964 | Williams . | |
| 3,280,420 | 10/1966 | Wanzenberg . | |
| 3,463,302 | 8/1969 | Preston | 15/104.94 |
| 3,485,349 | 12/1969 | Chaney, Jr. | 206/812 |
| 3,563,371 | 2/1971 | Clancy . | |
| 4,182,336 | 1/1980 | Black | 206/438 |
| 4,427,111 | 1/1984 | Laipply | 206/210 |
| 4,674,135 | 6/1987 | Greene . | |

*Primary Examiner*—Richard J. Johnson

*Attorney, Agent, or Firm*—Arthur G. Yeager

[57] ABSTRACT

An elongated device for applying lotion to the body which comprises a first elongated section and a second elongated section joined together through a pivot so as to be foldable upon each other in a closed condition. An applicator head hingedly attached to the first section at the end distant from such pivot and a compartment in one of the sections for storage of a plurality of soft absorbent pads attachable to the head.

20 Claims, 3 Drawing Sheets

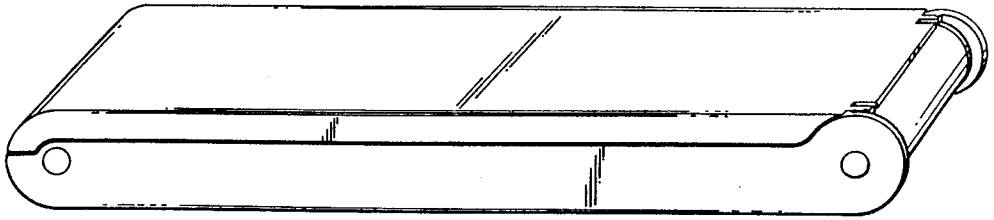
FIG 5
FIG 8
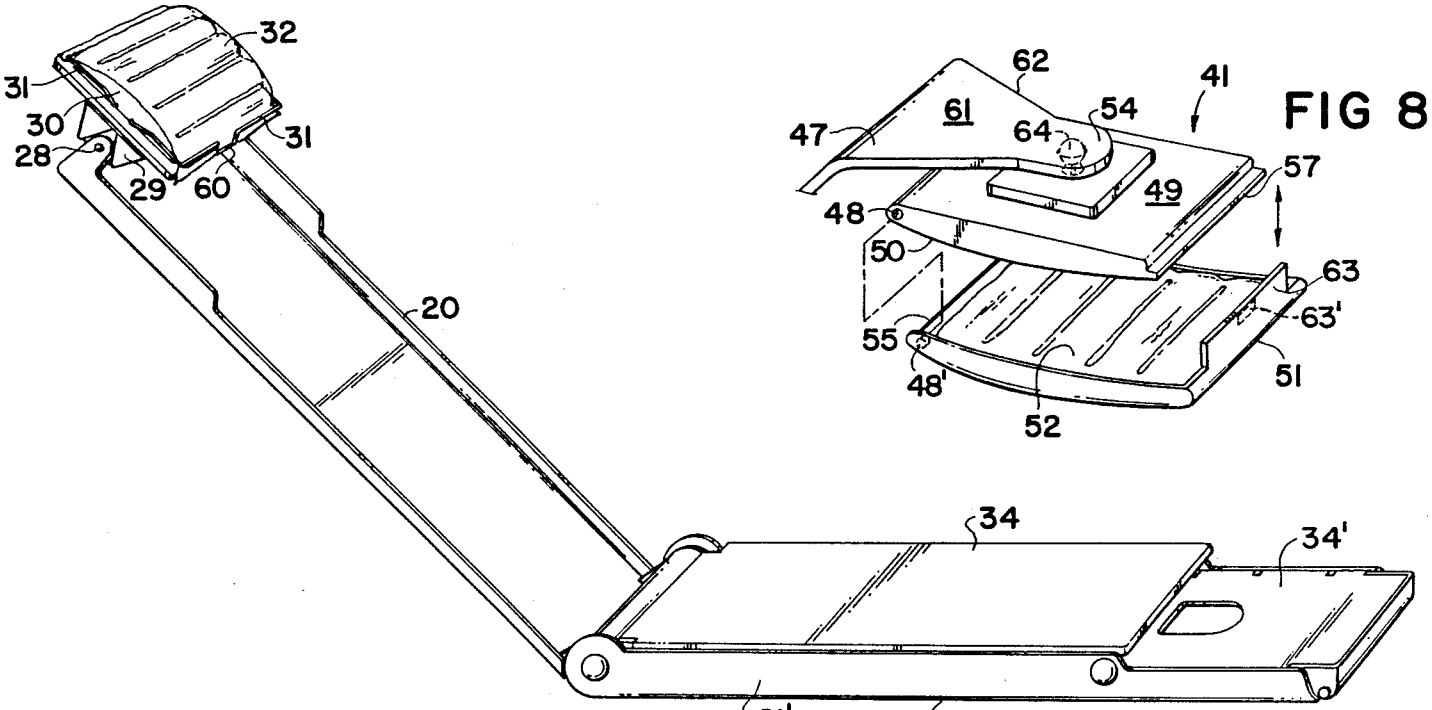
FIG 3

FOLDABLE LOTION APPLICATOR

BACKGROUND OF THE INVENTION

This invention relates to a device to be used in applying lotions, creams, oils, and the like to the body, especially to portions of the body that are difficult to reach with the hands. A particular example of the need for this applicator is the spreading of a sun screen lotion or a sun tan cream on the body of a bather. Not only is this a messy undertaking in that the lotion or cream is gummy and sticky on the hands, but also there are areas in the back that frequently are difficult, if not impossible, to reach by the hand of the user. Similarly, it is sometimes necessary to apply a cosmetic or dermatologic material to the back or other hard-to-reach skin areas. Nothing is available in today's market place, other than straight wands with rigidly fixed and non-pivoting heads, to serve such purposes. Also, with the handicapped and/or elderly persons, often it is even much more difficult to use a straight wand in making proper application to various body parts. Accordingly, it is an object of this invention to provide an improved hand-held lotion applicator. It is another object of this invention to provide such an applicator that employs commercially available cotton pads to apply the lotion, and then be thrown away. Still other objects will become apparent from the more detailed description which follows.

BRIEF SUMMARY OF THE INVENTION

This invention is directed to a device for applying lotion to the body comprising a compact structure of a first and a second elongated section which are joined together through a pivot means allowing the two sections to fold upon each other to form a generally uniform closed housing. The first section carries an applicator head onto which an absorbent material pad is attachable thereto adjacent the end of the first section distant from the pivot means. One of the first and second sections has a compartment for the storage of a supply of the absorbent pads. Additional compartments may be provided for used pads and/or refillable containers of lotion, for example.

In one specific embodiment of the invention the applicator head is detachable from the first section and is stored in a recess in the device. In a second specific embodiment of the invention the applicator head is hinged to the end of the first section and foldable into a recess for storage in the device.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 3 is a perspective view of the first embodiment with the applicator head in position for use;

FIG. 5 is a perspective view of a second embodiment of the applicator according to this invention in a closed position;

FIG. 8 is a perspective view of the applicator head of the second embodiment.

DETAILED DESCRIPTION OF THE INVENTION

One of the embodiments of the applicator of this invention is shown in FIGS. 1–4 and by referring to those drawings the invention may be well understood.

Figure 1:
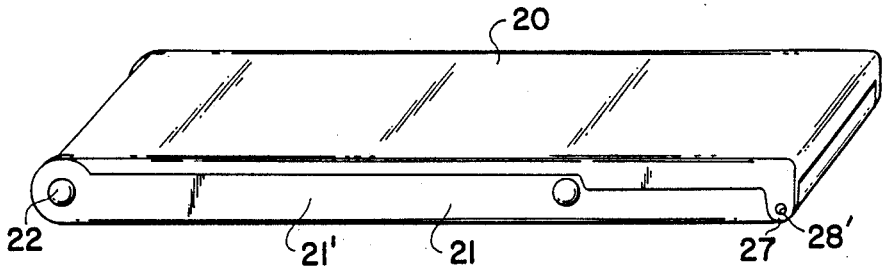
FIG. 1 is a perspective view of a first embodiment of the applicator in accord with the invention in its closed position.
Figure 4:
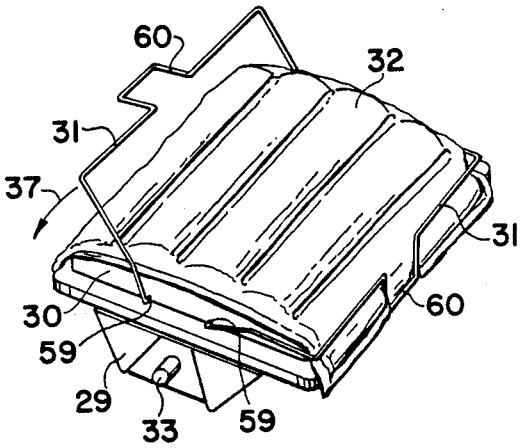
FIG. 4 is a perspective view of the applicator head of the first embodiment.
Figure 2:
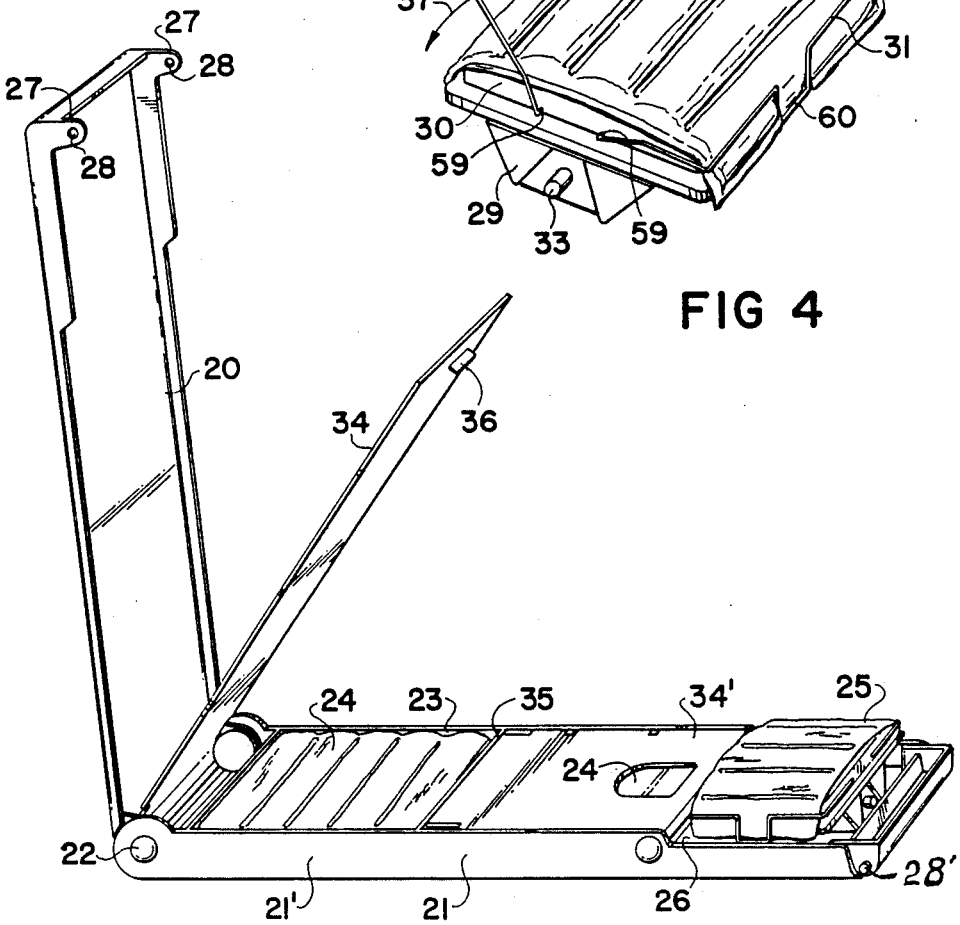
FIG. 2 is a perspective view of the first embodiment opened to show the interior compartments and arrangement thereof.

The applicator of this invention is in the form of a compact container which in its closed position as seen in FIG. 1 is an elongated rectangular box of two principal components; namely, first section 20 and second section 21 joined together by a pivot means 22. When first section 20 and second section 21 are opened by pivoting about a hinge pin in pivot means 22 it will be seen that first section 20 is a channel-shaped cover which fits snugly against second section 21 when closed. Second section 21 is an elongated member having compartments 23 for storage of the applicator head 25 and for supplies of applicator pads 24. Lateral walls 35 together with the side walls 21' and 21'' of second section 21 is formed into compartments 23. Compartment 26 which is most distant from pivot means 22 is designed to hold supplies of soft absorbent pads 24, preferably cotton pads, commercially sold for the application of cosmetics. The drawings (FIG. 2) show two compartments 23 for pads 24. It is, of course, not critical for this device to have any special number of compartment recesses 23. The size of second section 21 will determine whether two or more compartments 23 of pads 24 are possible. It will be obvious that only one compartment may be employed. Furthermore, if the lotion to be applied with this device comes in, or can be put into, a small container, there may be room to store that container in one of the compartments 23 and/or one of such compartments may be used for used or spent pads.

In this first embodiment the applicator head 25 is detachable from first section 20 and storable in compartment 26 in either the position shown or upside down. When it is time to use the device to apply lotion, applicator head 25 is removed from compartment 26 and attached to first section 20. In the design shown here, first section 20 has two ears 27 with small holes or passageways 28 through those ears to receive small pivot stub pins 33 (see FIG. 4) to permit head 25 to pivot somewhat and thereby be pushed easily over the skin areas to be treated with lotion. It will be seen that the device, when open, becomes an extension handle comprising first section 20 and second section 21, which is held in one hand, to apply lotion from pad 32 of applicator head 25. Passageways 28 receive protrusions 28' on opposite sides of section 21 when closed, as shown in FIG. 1.

Applicator head 25 comprises a supporting body 29 having a smooth convexly curved face 30 over which an absorbent pad 32 is placed, and clamped thereto by clamping means 31. Supporting body 29 may be of any desired design which provides a pair of stub pivot pins 33 projecting laterally outward on the sides of body 29 to engage holes 28 in ears 27. Preferably, ears 27 will be sufficiently flexible to be bent outward and permit pins 33 to be placed between ears 27 that can then be allowed to spring back to their normal position with pins 33 engaged in holes 28 so that the head 25 may have limited pivotal movement. Alternatively, one or both of pins 33 may be spring loaded away from each other to appropriately engage with corresponding holes 28 in ears 27. The clamping means 31 shown here include a pair of spring wire sections extending across the lateral width of pad 32 and face 30. The ends of the spring wire sections are attached to head 25 by being inserted into recesses 59 permitting each wire section 31 to be pivotable as shown by the two positions of wire clamps 31 in FIG. 4. Each wire clamp 31 has a bent section 60 in the middle thereof that can snap over a flanged portion around the edges of face 30 and thereby hold clamp wire 31 in place with an edge of pad 32 clamped against face 30.

Since the applicator is used in open condition a cover 34 is provided to keep dirt out of clean pads 24 and also serves to keep pads 24 from falling out of compartments 23 when in use. Cover 34 is generally a thin sheet of a size and shape to cover both of compartments 23 and to stay closed during use of the device. Any type of catch or lock can be used on cover 34. The type of catch shown here is merely a lug or wedge 36 that will hold cover 34 shut when it is closed over compartments 23. A depression or groove (not shown) in wall 35 to accommodate a small projection (not shown) on lug 36 is commonly used. Another partial cover 34' may be used to cover one of the compartments 23 which also may span compartment 26 to provide for a smoother grip to the hand of a user.

A second embodiment of this invention is shown in FIGS. 5–8 wherein the applicator head 41 (comparable to 25 in FIGS. 1–4) is not detachable from first section 38, but rather is pivotably attached thereto and folded inward to a storage compartment 44 when not in use. First section 38 and second section 39 are joined together by pivot means 40 so as to close upon each other to produce an elongated rectangular box. When first section 38 is opened and pivoted away from second section 39 as in FIGS. 6 and 7, there is produced an elongated handle with a storage compartment 44 for applicator head 41 and a storage compartment 43 for clean absorbent pads 45. Preferably, compartment 43 has a pivoting cover 46 which pivots around pivot means 40.

Applicator head 41 includes a support body 49 with a smooth face 50, preferably convexly curved outwardly to facilitate the application of lotion to the body, an absorbent pad 52 extending over face 50, and a frame clamp 51 which holds pad 52 against face 50. Frame clamp 51 may be completely separable from body 49 or it may be hinged thereto. Preferably, frame clamp 51 is flexible enough to snap-fit onto body 50 and remain there by a springy action of frame 50, e.g., by a flange around a portion of its perimeter, cooperating with a small projection or plurality of projections, such as a rib 57 on body 49. A beam structure, much like a cantilever beam 47 supports applicator head 41 in its open position and bears the force of applicator head 41 being pushed backwards during its use in applying lotion to the body. Beam 47 is pivoted at its proximal end around pivot pin 42 in first section 38. Beam 47 extends longitudinally outwardly from pivot pin 42 to an end 54 which is located generally in the middle of body 29. Beam 47 preferably has a triangular shape with its base along pivot pin 42 and its apex at end 54. A ball and socket connection 64 illustrated in broken lines in FIG. 8 to provide limited universal movement between body 49 and end 54 of beam 47 so that the head would more easily permit the application of lotions to the user's body. Support beam 47 is in the form of a channel with a solid bottom web 61 and upturned side legs 62 to provide for maximum strength and minimum weight and material.

In FIG. 8 there is shown one preferred embodiment of applicator head 41 wherein frame 51 is hinged to body 49 along one edge thereof at 55. If head 41 is a plastic structure of injection-molded material, a hinge may merely be a weakened thin portion of plastic which will bend like a hinge. The frame clamp 51 in FIG. 8 is shown in its exploded unattached position for clarity of illustration. While the frame 51 is in the open position, a pad 52 is slipped under frame 51 and over the curved face 50. Frame 51 may then be closed over pad 52 and body 49 and held in that position by any clamping means, e.g., a flexible flange 63 carrying a protrusion 63' along the front edge of frame 51 which flange 63 will flex outwardly to pass over a rib 57 projecting outwardly along the edge of body 49. An alternate hinge, to a weakened line, may be provided by a pair of holes at 48 and stub shafts 48' which can be fabricated in a known manner in the art. The frame 51 preferably includes a plurality of spaced rounded projections 65 which assists in maintaining the pad 52 in place on head 41 during use.

Figure 6:
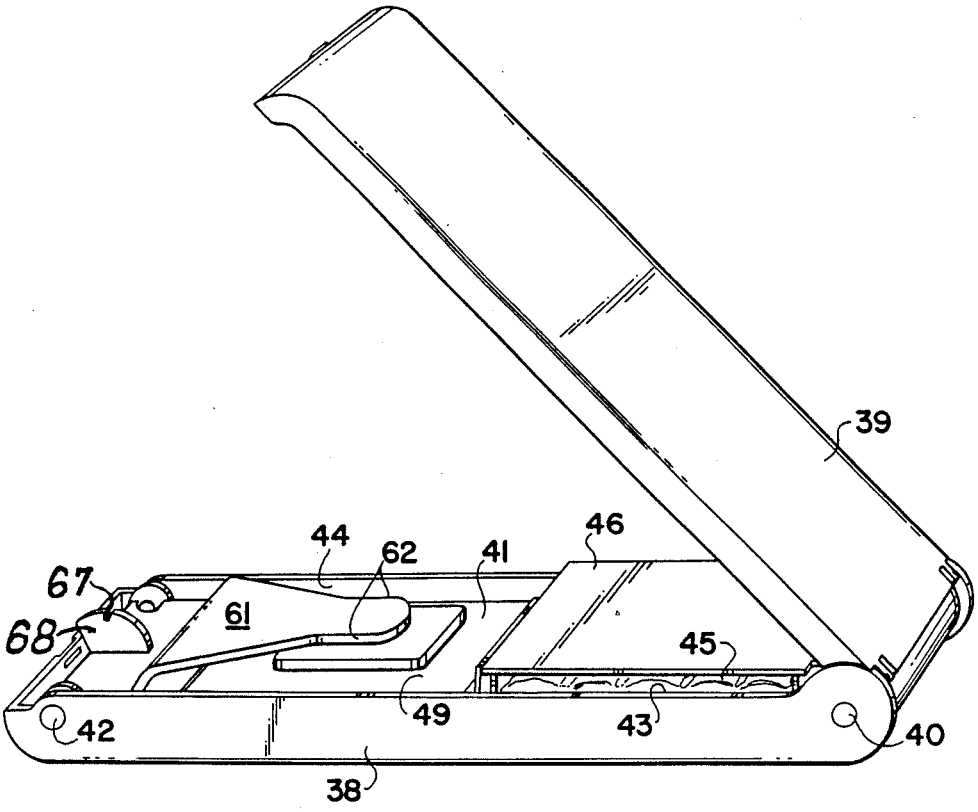
FIG. 6 is a perspective view of the second embodiment in an open position to show the interior compartments and the arrangement thereof.
Figure 7:
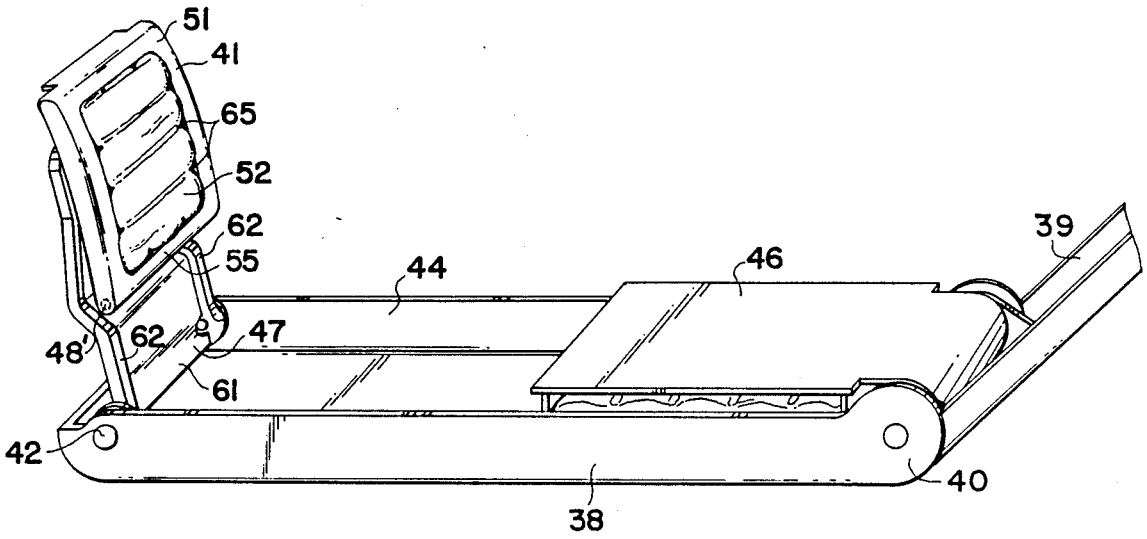
FIG. 7 is a perspective view of the second embodiment in the open position with the applicator head ready for use.

It is to be noted that when either of the applicators of this invention are opened for use in applying the lotion, sections 21 or 39 are gripped by the hand of the user and the other section 20 or 47 makes an included angle of about 120°–160°, preferably 130°–150°, so that hard to reach places may be applied with lotion without substantial contortions, etc. Also, the sections have a recess on one part adjacent the hinge means cooperating with a projection on the other part adjacent the hinge means so that the sections are locked open whereby the sections would not tend to close without a sufficient squeezing force being applied to the sections to close the applicator into their closed positions shown in FIGS. 1 and 5. Such a recess is shown in FIG. 6 by numeral 67 and the projection by numeral 68.

Preferably, the device of this invention is made of plastic by an injection-molding operation. Any of a variety of well known materials may be used for the material of construction, e.g., polyolefins, polyacetates, polycarbonates, polyacrylics, polystyrene, ABS resins, or the like.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. An applicator device for applying lotion to the body comprising an elongated structure having a longitudinal axis and having a first and a second elongated section each having opposite end portions, pivot means joining one said end portion of each said section together for movement of said sections between an open outstretched operative position substantially at least doubling said structure along its length and a closed nonoperative position in which said sections fold upon each other to substantially form a closed housing, said first section having an applicator head on its other said end portion, means attached to said head for reasonably carrying a pad of soft absorbent material thereon, and a compartment carried by one of said elongated sections between said sections for the storage of a supply of absorbent pads.

2. The device of claim 1 further comprising means for pivotally attaching said applicator head to said one end portion of said first section.

3. The device of claim 1 wherein said applicator head is removably attached to said first section.

4. The device of claim 3 which additionally includes means for storing said removable head between said sections.

5. The device of claim 1 which additionally comprises a selectively openable cover for said compartment to retain a supply of absorbent pads therein during use of said device in its operative position.

6. The device of claim 2 wherein said first section includes a storage recess to accommodate said applicator head between said sections when said sections are folded upon each other.

7. The device of claim 3 wherein said first section is an elongated channel structure with two laterally spaced ears at the end distant from said pivot means, each ear having a lateral passageway therethrough; said second section being an elongated channel structure laterally divided into at least two recesses, one of said recesses adapted to store said applicator head and the remaining recess or recesses adapted to store soft absorbent applicator pads attachable to said head; and a thin flat cover pivoted at said pivot means and adapted to close over said remaining recess or recesses and forming therewith said compartment; said head having a supporting convexly curved face to receive one of said applicator pads thereon, a means for removably attaching said pad to said face, and a pair of pins projecting laterally outward in opposite directions from each other and adapted to be located in respective said passageways.

8. The device of claim 7 wherein said means for removably attaching said pad comprises a pair of pivotable clamping pins operatively attached t said head and adapted to snap-fit around a portion of the perimeter of said pad and clamp said pad to said supporting face.

9. The device of claim 6 wherein said applicator head comprises a supporting body with a face against which said pad is adapted to lie, said means attached to said head including a frame having a central opening and flanges around the perimeter thereof, said opening being substantially the size and shape of said face and said flanges being adapted to snap-fit onto said body with one of said pads lying on said face so as to temporarily attach said pad to said face.

10. The device of claim 1 wherein said sections when fully open in operative position have an included angle between 120°–160° so that a user may grasp said second portion adjacent its other said end portion and reach all parts of a user's body, by said applicator head with minimal contortions.

11. The device of claim 6 which additionally comprises a head supporting beam structure which is pivotally attached to the other said end of said first section distant from said pivot means, said head supporting beam being adapted to pivot lengthwise of said first section so as to provide an additional length to said beam structure when said head is pivoted open to an operative position, and to fold upon said beam structure when said head is closed to a nonoperative position.

12. An applicator device for applying lotion to the body comprising in combination a first and a second elongated section of substantially equal length and each having opposite end portions, pivot means connecting one said end portion of each of said sections together for permitting said sections to fold upon each other to substantially form a closed outer housing during non-use thereof and to open to substantially twice the length of each section during use thereof, an applicator head being supported by said first section adjacent its other said end portion, means for removably mounting an applicator pad of soft absorbent material on said head, one of said elongated sections having a compartment for the storage of a supply of absorbent pads between said sections and another compartment for the storage of said applicator head between said sections during non-use thereof.

13. The device of claim 12 wherein said applicator head is removably attached to said first section.

14. The device of claim 13 wherein said first section is an elongated channel structure with two laterally spaced ears at the end distant from said pivot means, each ear having a lateral passageway therethrough, said second section being an elongated channel structure laterally divided into at least two recesses, one of said recesses forming said other compartment adapted to store said applicator head and a second said recess adapted to store soft absorbent applicator pads attachable to said head, and a thin flat cover pivoted at said pivot means and adapted to close over said second recess and forming therewith said compartment, said head having a supporting face adapted to receive one of the applicator pads thereon, means for removably attaching an applicator pad to said face, and a pair of pins projecting laterally outward in opposite directions from each other and adapted to be located in respective said passageways.

15. The device of claim 14 wherein said means for removably attaching an applicator pad comprises a pair of pivotable clamping pins operatively attached to said head and adapted to snap-fit around and frictionally engage a portion of a perimeter of an applicator pad and clamp same to said supporting face.

16. The device of claim 12 which additionally comprises a selectively openable cover for said compartment to retain a supply of absorbent pads therein during use of said device.

17. The device of claim 12 wherein said applicator head comprises a supporting body with a face against which an applicator pad is adapted to lie, said means for removably mounting including a frame pivotally attached to said body and having a central opening and at least one flange opposite to its pivotal attachment, said opening being substantially the size and shape of said face and said flange being adapted to snap-fit onto said body with an applicator pad lying on said face so as to temporarily frictionally attach same to said face.

18. The device of claim 12 wherein said sections when fully open in operative position have an included angle between 120°–160 ° so that a user may grasp said second portion adjacent its other said end portion all parts of a user's body with minimal contortions.

19. The device of claim 12 which additionally comprises a head supporting beam structure, another pivot means for connecting said beam structure to the other said end portion of said first section distant from said pivot means, said beam structure being adapted to pivot lengthwise of said first section so as to provide an additional length to said device when said head is pivoted open to an operative position and to fold upon said beam structure when said head is closed to a nonoperative position.

20. The device of claim 19 further comprising means for attaching said head to said beam structure for universal limited movement therebetween to enhance the movement and conformance of said head over contours of a body of a user.

* * * * *